US005612133A

United States Patent [19]

Mori et al.

[11] Patent Number: 5,612,133

[45] Date of Patent: Mar. 18, 1997

[54] MAGNETO-OPTICAL RECORDING MEDIUM HAVING A REFELECTING LAYER OF A SILVER-MAGNESIUM ALLOY HAVING A MAGNESIUM OXIDE COATING

[75] Inventors: Rie Mori; Kenichi Hijikata, both of Saitama, Japan

[73] Assignee: Mitsubishi Materials Corporation, Tokyo, Japan

[21] Appl. No.: 631,623

[22] Filed: Apr. 5, 1996

Related U.S. Application Data

[60] Continuation of Ser. No. 402,845, Mar. 13, 1995, abandoned, which is a division of Ser. No. 231,484, Apr. 22, 1994, abandoned.

[30] Foreign Application Priority Data

Apr. 22, 1993 [JP] Japan ..... 5-120689
Apr. 12, 1994 [JP] Japan ..... 6-98046

[51] Int. Cl.[6] ..... G11B 5/66

[52] U.S. Cl. ..... 428/336; 428/457; 428/471; 428/694 RL; 428/900

[58] Field of Search ..... 428/694 RL, 457, 428/900, 336, 471

[56] References Cited

U.S. PATENT DOCUMENTS 2,161,254 6/1939 Hensel et al. ..... 420/501
4,786,559 11/1988 Murakami et al. ..... 428/472

FOREIGN PATENT DOCUMENTS 62-239349 10/1987 Japan .
03025737 2/1991 Japan .
04038737 2/1992 Japan .
04061045 2/1992 Japan .

OTHER PUBLICATIONS

CA 82:23849 Savitskii, E.M. et al Splavy Redk. Met. Osobymi Fiz. Svoistvami, Mater. Vses. Soveshch. 1974 pp. 129–130.

*Primary Examiner*—Stevan A. Resan
*Attorney, Agent, or Firm*—Sughrue, Mion, Zinn, Macpeak & Seas

[57] ABSTRACT

Silver is alloyed with magnesium, and the magnesium content of the silver-magnesium alloy ranges from 1 atom % to 10 atom % so that a protection film of magnesium oxide prevents the silver-magnesium alloy from sulfur and ozone without an intermetallic compound.

4 Claims, 11 Drawing Sheets

MAGNETO-OPTICAL RECORDING MEDIUM HAVING A REFELECTING LAYER OF A SILVER-MAGNESIUM ALLOY HAVING A MAGNESIUM OXIDE COATING

This is a continuation of application Ser. No. 08/402,845 filed Mar. 13, 1995 now abandoned which is a divisional of application Ser. No. 08/231,484 filed on Apr. 22, 1994 now abandoned.

FIELD OF THE INVENTION

This invention relates to silver-magnesium alloy and, more particularly, to silver-magnesium alloy resistive against sulfur and ozone corrosion.

DESCRIPTION OF THE RELATED ART

Silver is superior in luster, ductility and malleability, and is one of the highly conductive metals. Moreover, silver has almost 100% reflectance over a wide range of wavelengths, and has a bactericidal effect in water. Silver is stable, and is hardly oxidized a in high temperature atmosphere. These features are attractive for industries, and silver finds a wide variety of uses such as, for example, a reflecting film laminated on a magneto-optical recording medium or a dinner set.

However, sulfur or sulfur component of a sulfide easily corrodes silver at room temperature, and produces silver sulfide $Ag_2S$. Silver sulfide is brown or black, and damages the luster. Though not less active than sulfur, ozone also corrodes silver, and produces black AgO.

The brown or black sulfide may be desirable for a decorative art. However, the sulfide is usually undesirable, and various protections have been applied to silver products. One of the protections is to treat a silver product with chromic acid, and another silver product is coated with a transparent resin. The most effective protection is to coat a silver product with rhodium. However, the coating with rhodium is so expensive that manufacturers apply all the silver products, and the other protections hardly provide effective protection against sulfur and ozone. Moreover, the coating films are liable to peel from the silver products.

If the silver coating is used as the reflection layer film of the magneto-optical recording medium, the silver coating or the reflection film radiates the heat applied to a magnetic film, and the magnetic film hardly exceeds the Curie temperature.

SUMMARY OF THE INVENTION

It is therefore an important object of the present invention to provide an alloy which is low in heat conductivity, high in reflectance and free from the deterioration in luster.

It is also an important object of the present invention to provide usage of the alloy.

The present inventors noticed that magnesium was rich in luster, ductility and malleability, and the magnesium did not deteriorate the attractive features of silver. Moreover, the present inventors noticed that magnesium was oxidized in room temperature, and the magnesium oxide was so stable that sulfur and ozone could not corrode the silver. The present inventors concluded that a silver-magnesium alloy was a solution to the problems.

Therefore, the present invention proposes to alloy silver with magnesium.

In accordance with the present invention, there is provided a silver-magnesium alloy containing magnesium ranging from 1 atom % to 10 atom %.

The maximum magnesium content may be limited to 8 atom % for a reflection layer of a magneto-optical recording medium, and may be limited to 5 atom % for a reflection layer of an optical record medium, a reflector, a sign or an illuminator.

BRIEF DESCRIPTION OF THE DRAWINGS

The features and advantages of the alloy according to the present invention will be more clearly understood from the following description taken in conjunction with the accompanying drawings in which.

DESCRIPTION OF THE PREFERRED EMBODIMENTS

A silver-magnesium alloy embodying the present invention contains magnesium ranging from 1 atom % to 10 atom %. Magnesium has silver luster, and is ductile and malleable for foliation. These affinities alloy silver with magnesium. Magnesium is oxidizable rather than silver in room temperature, and magnesium oxide is formed over the entire surface. The magnesium oxide is stable, and serves as a protection film against the sulfur and ozone corrosion of silver. The magnesium oxide is transparent, and the silver-magnesium alloy maintains the silver luster over long time period.

The reason for the magnesium content is that magnesium less than 1 atom % hardly forms an effective protection film against the sulfur and ozone corrosion of silver. If the magnesium content is greater than 10 atom %, magnesium and silver form an intermetallic compound over the surface, and the intermetallic compound is hardly oxidized at room temperature. In other words, the magnesium-rich alloy can not form the effective protection film.

If the silver-magnesium alloy is placed in high-temperature high-humidity atmosphere, the oxidation is accelerated, and the magnesium oxide film rapidly covers the silver-magnesium alloy.

The magnesium in the surface portion is consumed in the oxidation, and the surface portion is formed of pure silver and the magnesium oxide. The reflectance of the remaining silver ranges from 90% to 95%, and the reflectance is close to pure silver at 98%.

On the other hand, the silver-magnesium alloy is left beneath the surface portion, and the heat transfer coefficient is a third of pure silver.

Thus, the silver-magnesium alloy implementing the embodiment achieves the high reflectance and the low heat transfer coefficient, and is available for a reflection film of a magneto-optical recording medium.

The present inventors deposited the silver-magnesium alloy on a substrate by using a sputtering system. A silver target and a magnesium target were placed in the sputtering system, and controlled the high-frequency electric power so as to adjust the composition within the target range described hereinbefore. In this instance, the magnesium content averaged 6.18 atom %. The substrate may be moved between two positions where silver flux and magnesium flux fall for regulating the silver and magnesium contents.

Figure 1:
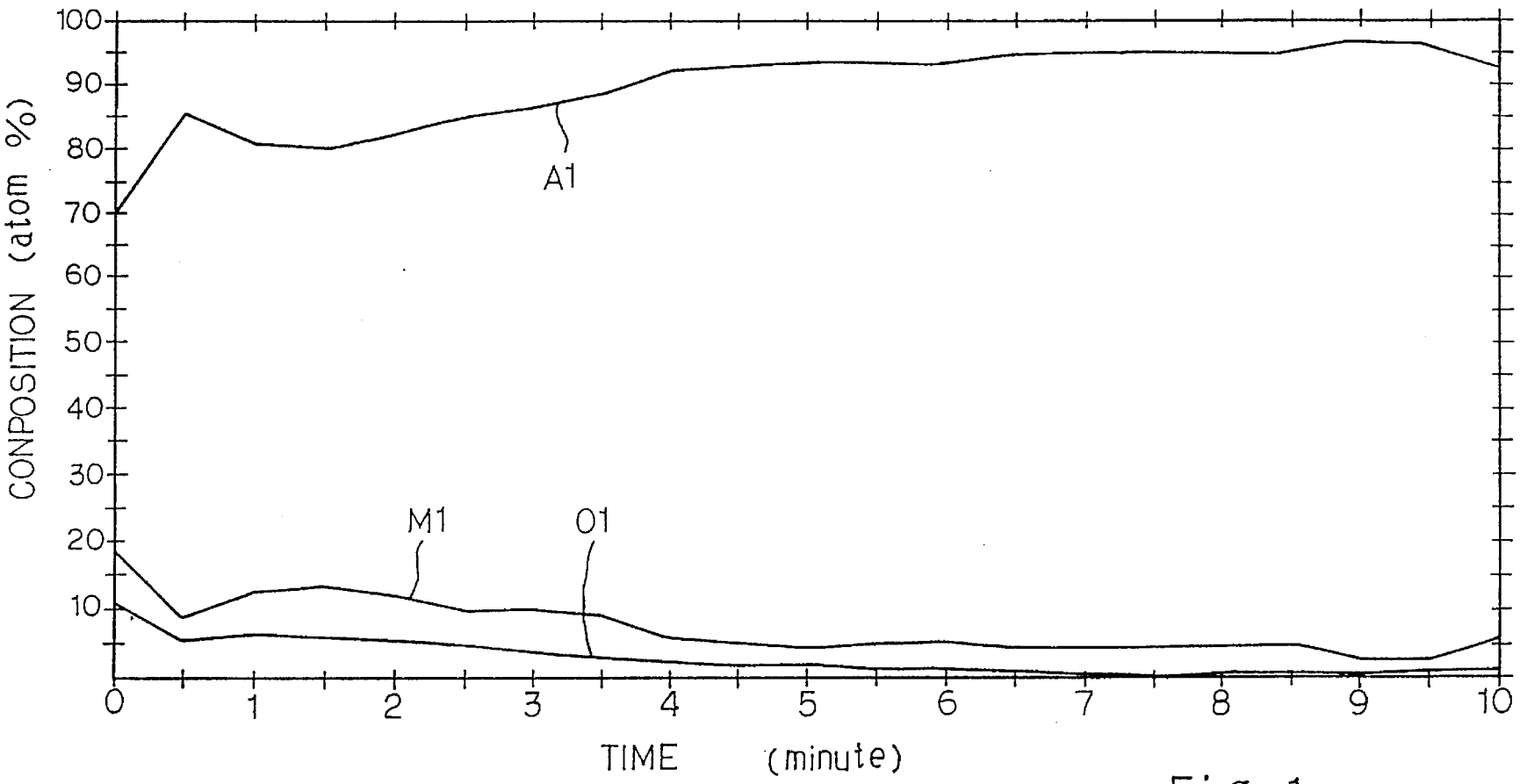
FIG. 1 is a graph showing variation of the composition of a silver-magnesium alloy according to the present invention in terms of time convertible into the depth from the surface of the silver-magnesium alloy.

The silver-magnesium alloy was analyzed by using an Auger analyzer. FIG. 1 shows relation between the composition of the silver-magnesium alloy immediately after the deposition and time consumed for an etching after the sputtering. Plots A1, plots M1 and plots O1 are indicative of the silver content, the magnesium content and the oxygen content, respectively. The contents at zero minute represents the composition in the uppermost surface, and the contents at 10 minutes are indicative of the composition of the silver-magnesium alloy at 1000 angstroms deep from the uppermost surface. The deposited silver-magnesium alloy film was etched away at intervals, the time roughly represents the depth from the surface.

Figure 2:
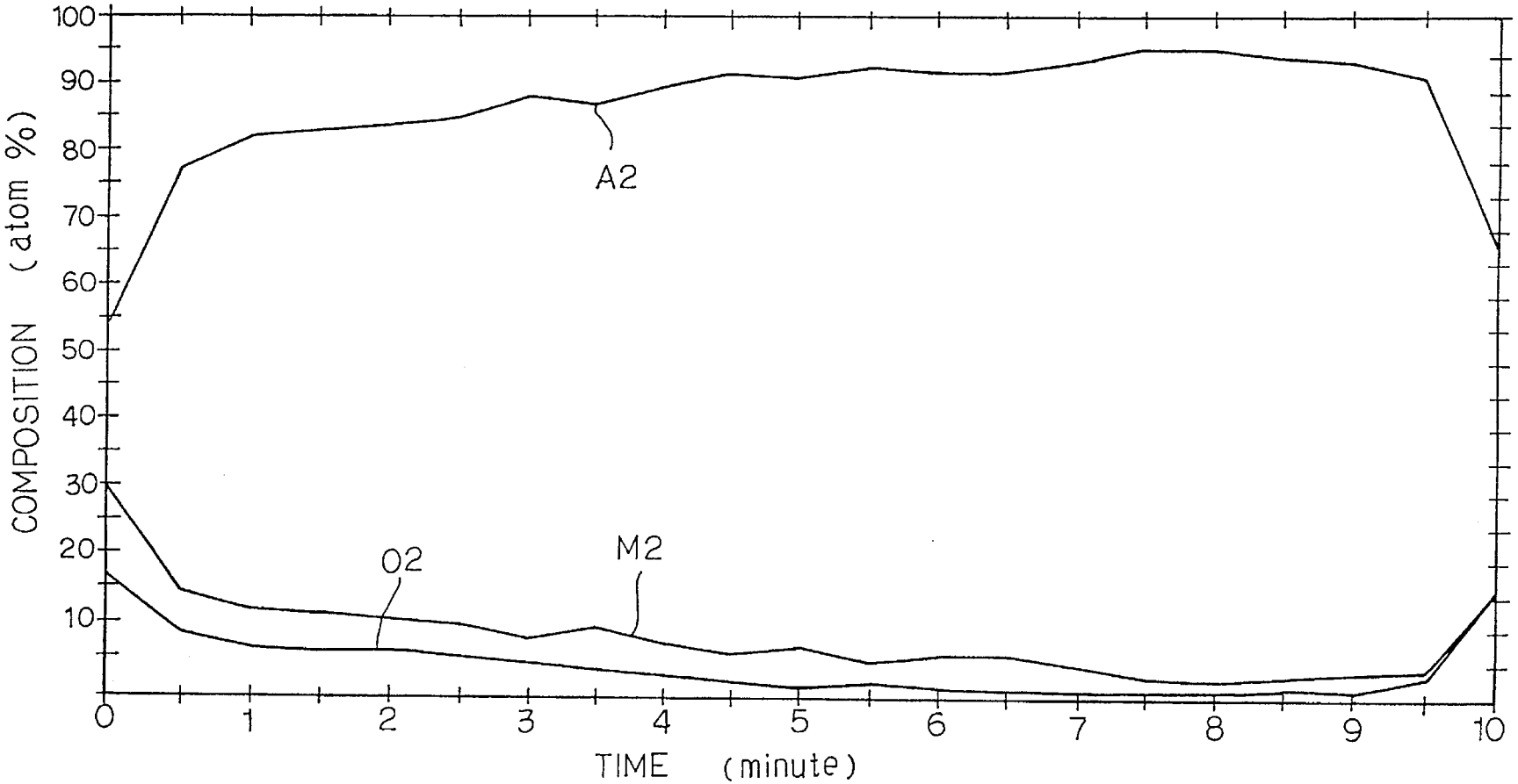
FIG. 2 is a graph showing variation of the composition after an oxidation in terms of time for the time.

The silver-magnesium alloy was left in an oxidizing atmosphere at 80 degrees centigrade under relative humidity of 85% for 24 hours, and an oxidizing atmosphere was created in a constant-temperature moisture vessel. The silver-magnesium alloy was analyzed after the oxidation again. The silver content A2, the magnesium content M2 and the oxygen content O2 were plotted in FIG. 2.

Comparing plots A1 and M1 with A2 and M2, the silver content in the surface is decreased from 70 atom % to 50 atom %, and the magnesium content in the surface is increased from 20 atom % to 30 atom %. The increase of magnesium content is derived from production of the magnesium oxide in the surface, and the oxidation increases the silver content in the surface.

Figure 3:
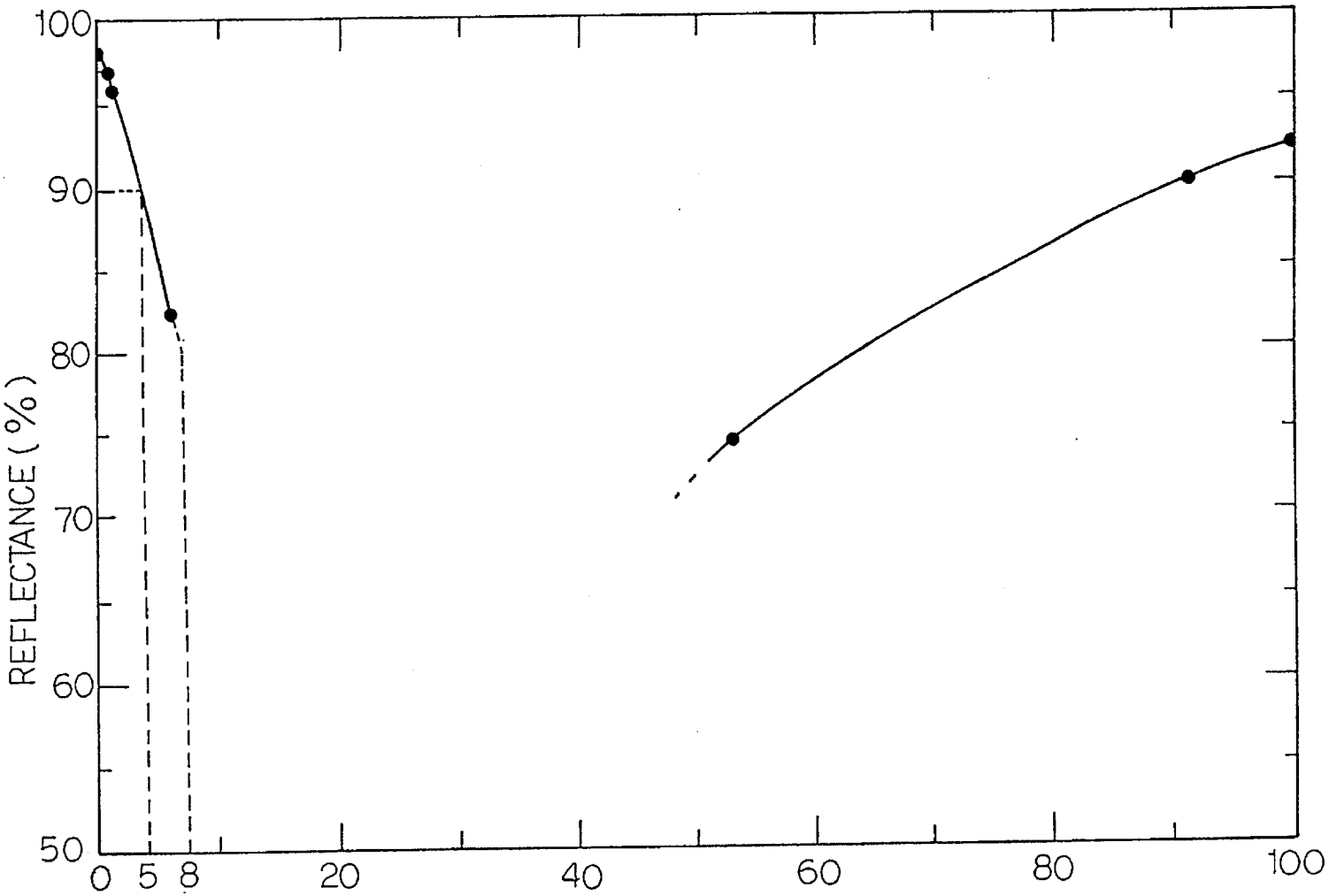
FIG. 3 is a graph showing relation between the reflectance and the magnesium content of silver-magnesium alloy.

The present inventors deposited silver-magnesium alloys by using a co-sputtering system, and the magnesium content was varied. A laser beam with wavelength of 632.8 nanometer was radiated onto the silver-magnesium alloys, and the reflectance was measured by using an ellipsometer. The reflectance was plotted in FIG. 3.

Figure 4:
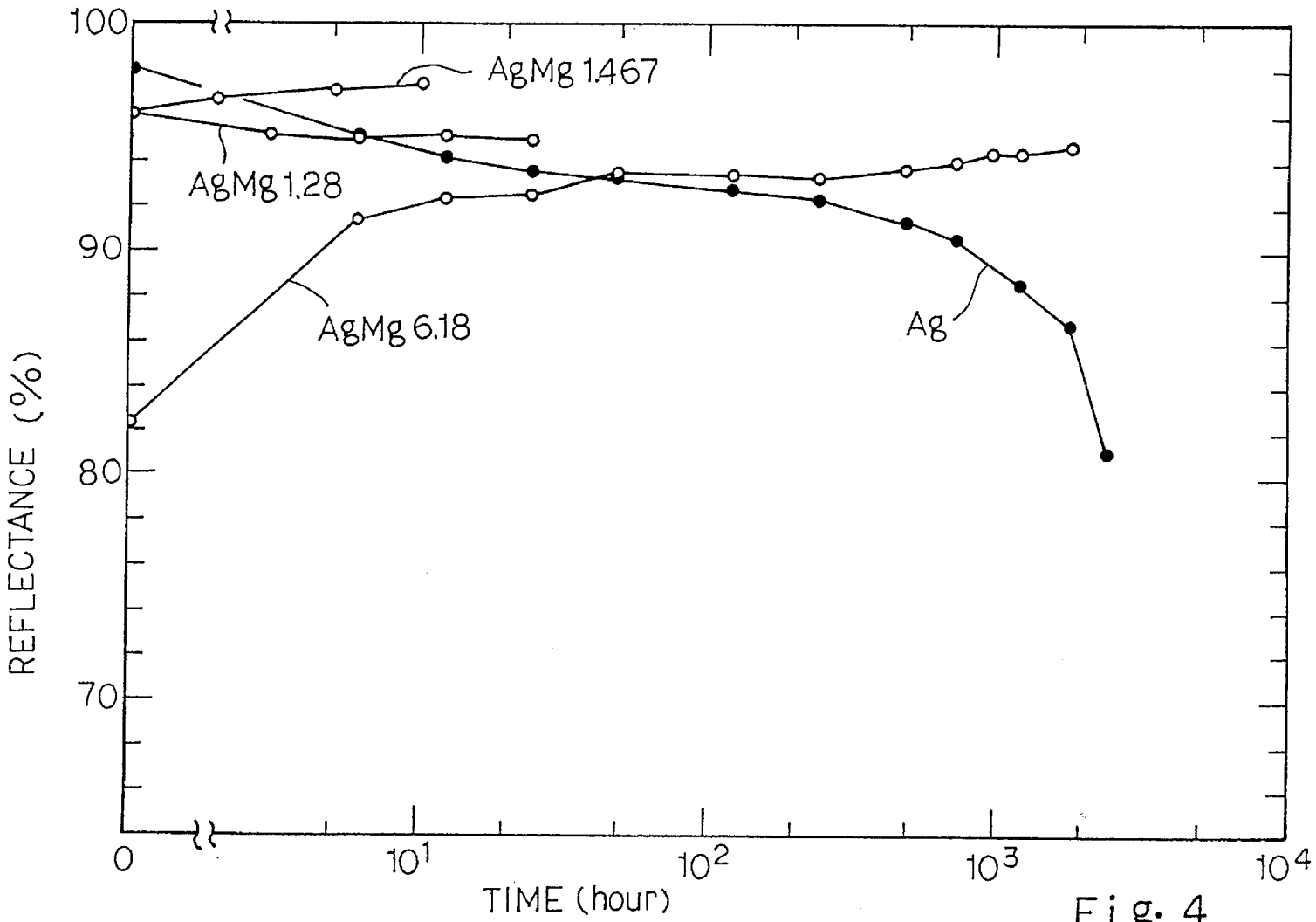
FIG. 4 is a graph showing variation of reflectances in terms of time in a corrosion test.

The present inventors prepared silver-magnesium alloys by using the co-sputtering technique, and the silver-magnesium alloys had respective compositions expressed as $AgMg_{1.28}$, $AgMg_{1.467}$ and $AgMg_{6.18}$. The silver-magnesium alloys and silver were corroded in wet atmosphere with relative humidity of 85% at 80 degrees centigrade. The progress of the corrosion was monitored by the ellipsometer, and the reflectance was plotted in FIG. 4. The silver-magnesium alloy $AgMg_{6.18}$ increased the reflectance together with time, and became constant after 8 hours.

The purity of the silver was deteriorated with time due to corrosion. On the other hand, the silver-magnesium alloys maintained or increased the reflectance. This phenomenon is derived from the protection films of magnesium oxide, and the corrosion test verified the efficiency of the protection film of magnesium oxide.

Figure 5:
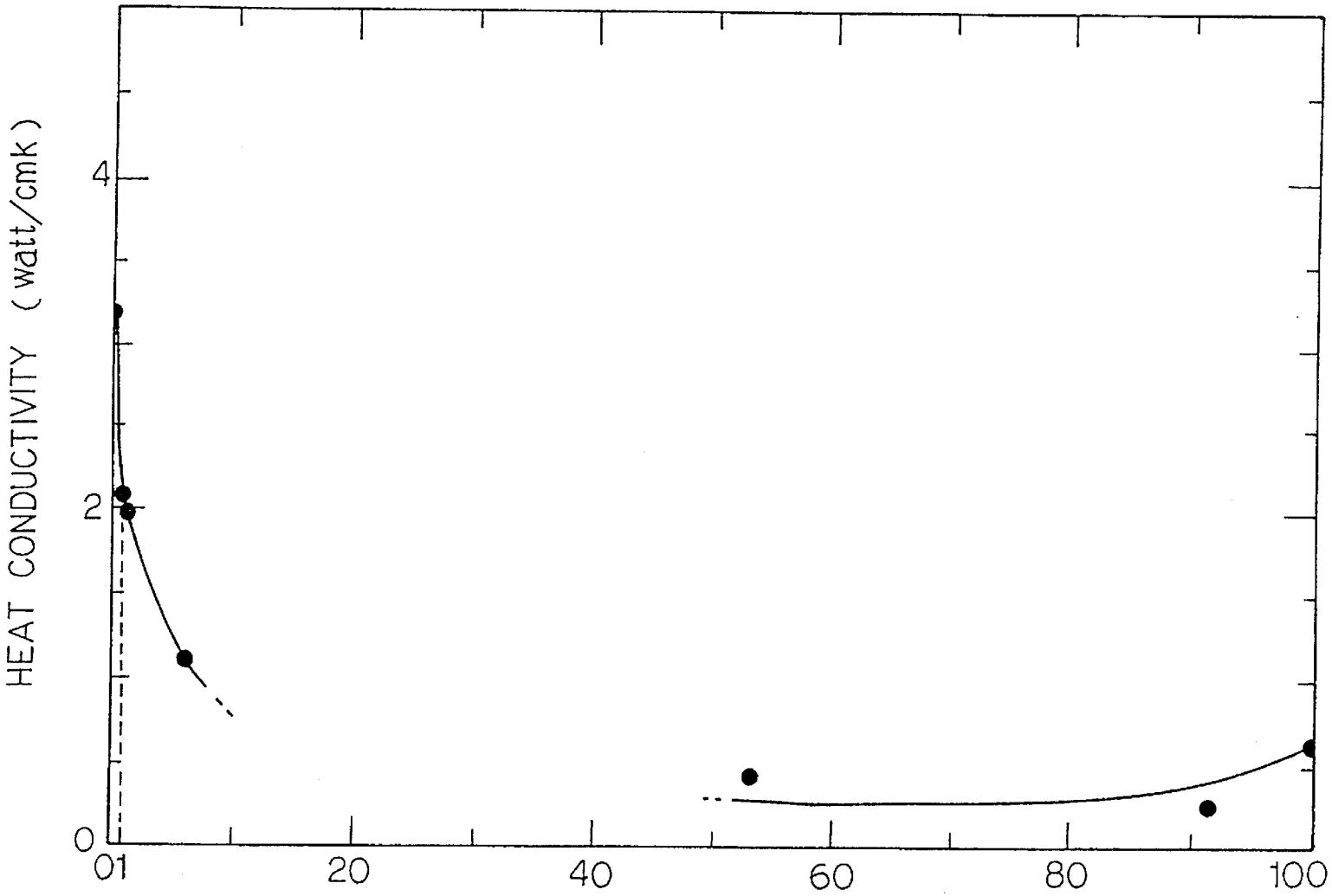
FIG. 5 is a graph showing relation between the heat conductivity and the magnesium content of silver-magnesium alloys.

The present inventors plotted the heat conductivity of the silver-magnesium alloys in terms of the magnesium content in FIG. 5 . First, the present inventors deposited the silver-magnesium alloys to 1000 angstroms, and measured the electric conductivity (sigma) along the surfaces of the deposited films by using a four-prove measuring system. The heat conductivity K was obtained through the Wiedemann-Franz' law as follows.

$$K=L\times(sigma)\times T$$

where L is Lorenz factor and T is the absolute temperature. FIG. 5 teaches us that the magnesium content equal to or greater than 8 atom % drastically lowers the heat conductivity.

However, not only a low heat conductivity but also a high reflectance are expected to a reflection layer of a magneto-optical recording medium. The maximum heat conductivity is two third of the heat conductivity of silver, and the minimum reflectance is 80%. The heat conductivity of silver is 3.204 watt/cm K, and the maximum heat conductivity is 2.14 watt/cm K. The maximum magnesium content is determined by using FIG. 3, and is about 8 atom %. On the other hand, the heat conductivity limits, and FIG. 5 teaches the minimum magnesium content at 1 atom %. The magnesium content at 1 atom % is also the minimum content for producing the magnesium oxide as described hereinbefore. The present inventors conclude that the magnesium content between 1 atom % and 8 atom % is desirable for the reflection layer of a magneto-optical recording medium.

Figure 6:
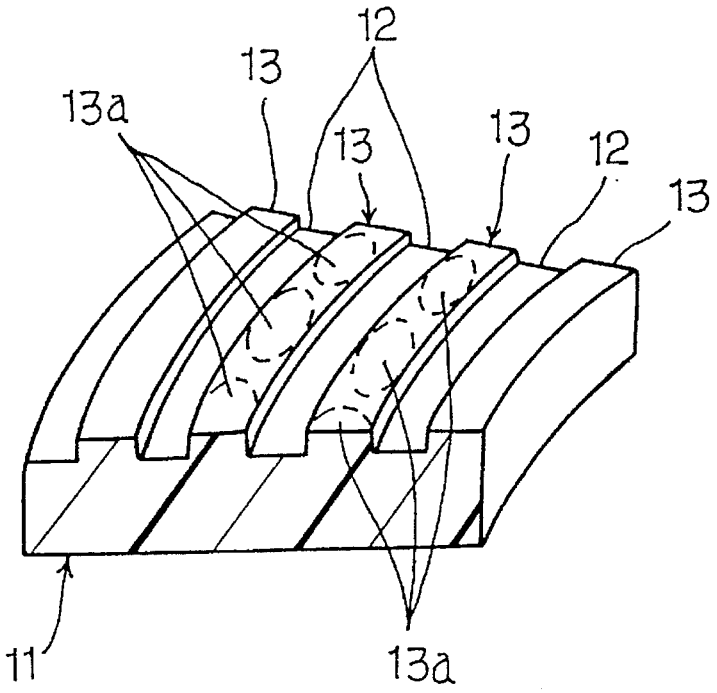
FIG. 6 is a perspective view showing a part of a magneto-optical recording disk having a reflection layer of silver-magnetic alloy according to the present invention.

Turning to FIG. 6 of the drawings, part of a polycarbonate substrate 11 is illustrated, and cocentric pregrooves 12 are formed on the surface portion of the polycarbonate substrate 11. The pregrooves 12 separate cocentric regions 13 from one another.

Figure 7:
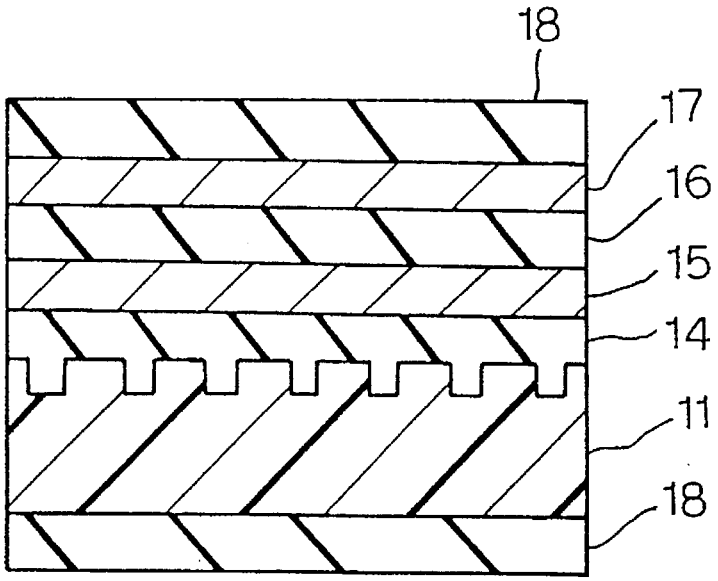
FIG. 7 is a cross sectional view showing the structure of the magneto-optical recording disk.

A protective layer 14 of SiAlON or $Si_3N_4$ covers the major surface of the polycarbonate substrate 11 (see FIG. 7), and a recording layer 15 of TbFeCo or TbFeCoCr is laminated on the protective layer 14. In this instance, the recording layer 15 is 200 to 250 angstroms in thickness. Another protective layer 16 covers the recording layer 15, and a reflection layer 17 is laminated on the protective layer 16. The reflection layer 17 is formed of silver-magnesium alloy implementing the embodiment, i.e., the magnesium content ranging between 1 atom % and 8 atom %, and is 500 to 1000 angstroms in thickness. Protective coating films 18 are laminated on the reflection layer 17 and the back surface of the polycarbonate substrate 11. The component layers of the disk except for the reflection layer 17 may be analogous to a prior art magneto-optical recording disk.

Both of or either of the protective layers 14 and 16 may be deleted from the magneto-optical recording disk, and another component layer such as a buffer layer may be further incorporated in the magneto-optical recording disk.

In a recording mode, a laser beam heats the recording layer 15 over the Curie temperature so that a magnetic field can change the orientation of each magnetic domain in the recording layer 15. On the other hand, the orientation of each magnetic domain is detected by a suitable detector in a read-out mode so as to retrieve the data bits.

Cocentric recording regions of the recording layer 15 are defined over the cocentric regions 13, and are available for a data recording. Data bits are assigned to small sub-areas 13*a* in the cocentric recording regions 13 (see FIG. 6), and the small sub-areas are corresponding to the magnetic domains.

Figure 8:
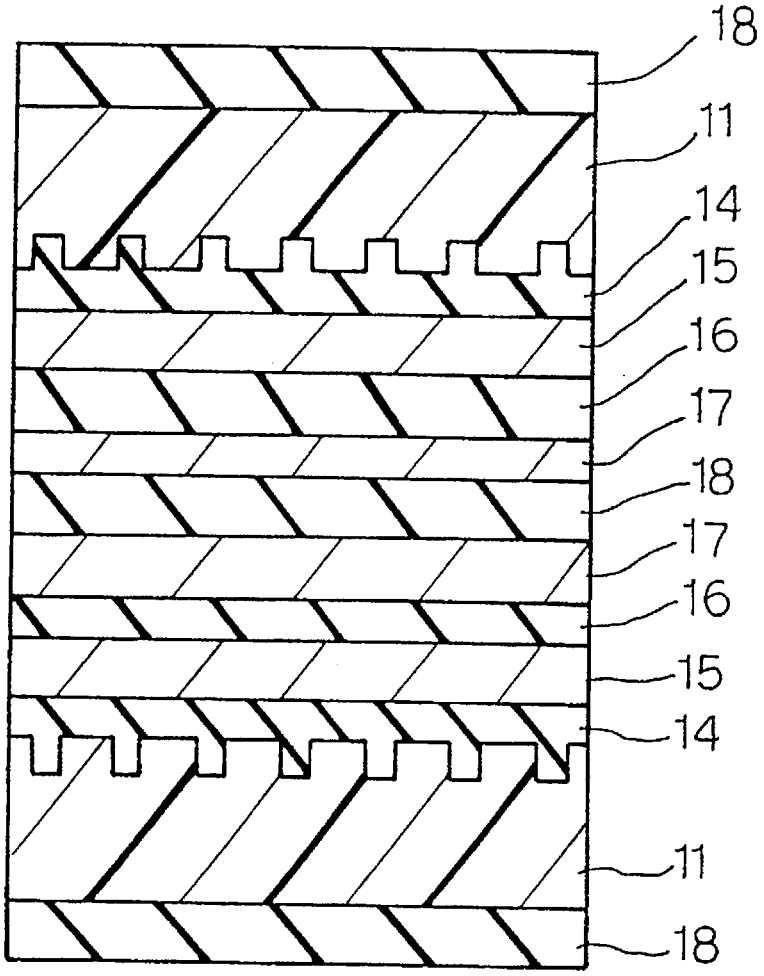
FIG. 8 is a cross sectional view showing the structure of another magneto-optical recording disk having a reflection layer of silver-magnetic alloy according to the present invention.

The reflection layer 17 may be incorporated in a 5.25-inch magneto-optical recording disk as shown in FIG. 8.

Figure 9:
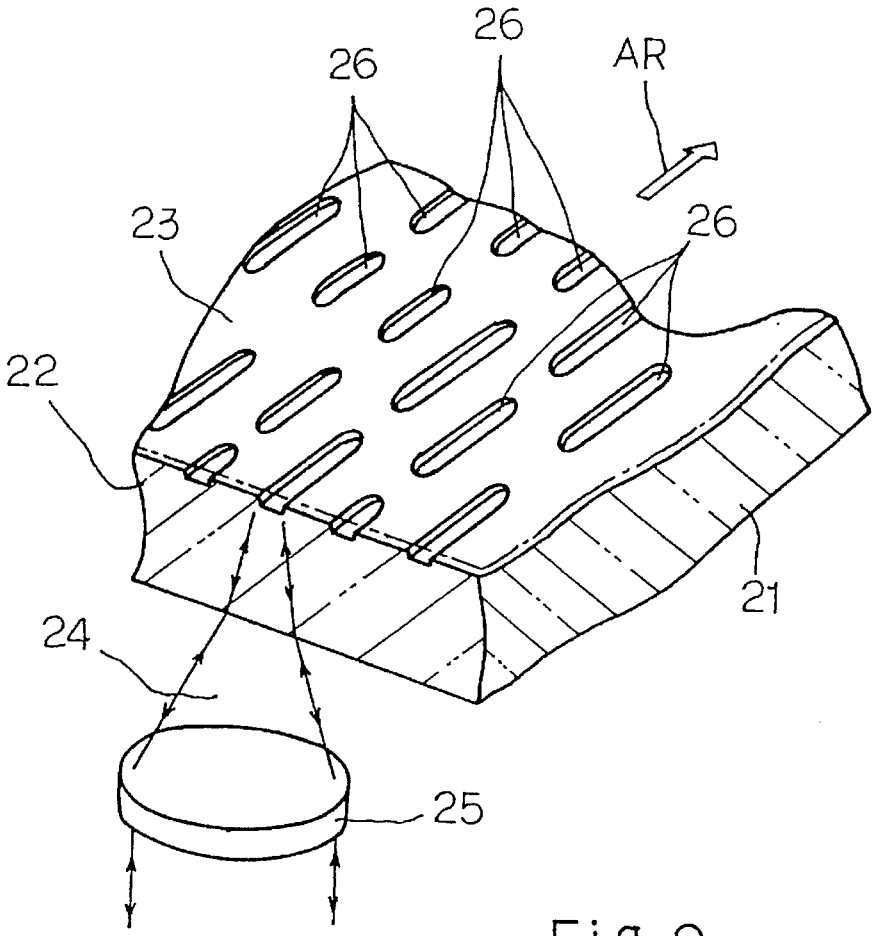
FIG. 9 is a perspective view showing a part of an optical record disk having a reflection layer of silver-magnetic alloy according to the present invention.

A reflection layer of silver-magnesium alloy is further available for an optical record medium such as, for example, an optical record disk and an optical record card. FIG. 9 illustrates an optical record disk which comprises a transparent substrate of plastic resin 21, a reflection layer 22 overlain by a protective layer 23 of SiAlON or $Si_3N_4$. The optical record disk is sometimes called as "compact disk" for reproducing a music. The reflection layer 22 is 500 to 1000 angstroms in thickness, and the silver-magnesium alloy contains magnesium ranging from 1 atom % to 5 atom %. The reflection layer 22 is expected to have the reflectance not less than 90%, and FIG. 3 teaches the maximum magnesium content of 5 atom %. A low heat conductivity is not requested for the optical record disk, and the production of magnesium oxide limits the minimum magnesium content.

The optical recording disk is driven for rotation in a direction indicated by an arrow AR, and a laser beam 24 is radiated through an objective lens 25 for reading out data information stored in the form of arrangement of pits 26.

Figure 10:
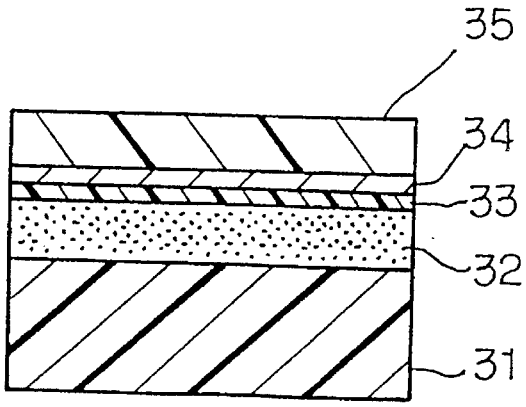
FIG. 10 is a cross sectional view showing the structure of an illuminator having a reflection layer of silver-magnesium alloy according to the present invention.

Turning to FIG. 10 of the drawings, a reflection layer incorporated in an illuminator comprises a base plate 31 of synthetic resin, an adhesive layer 32, a sealing layer 33, a reflection layer 34 of silver-magnesium alloy and a top-coating layer 35 . In this instance, the magnesium content of the silver-magnesium alloy ranges between 1 atom % and 5 atom %, and the reflection layer 34 is 1000 to 2000 angstroms thick, because the anti-corrosion resistance and the reflectance are important in this usage. The reflectance should be larger than that of aluminum, and is not to be less than 90%.

The reflection layer may be deposited on a thin plate of polycarbonate resin.

Figure 11:
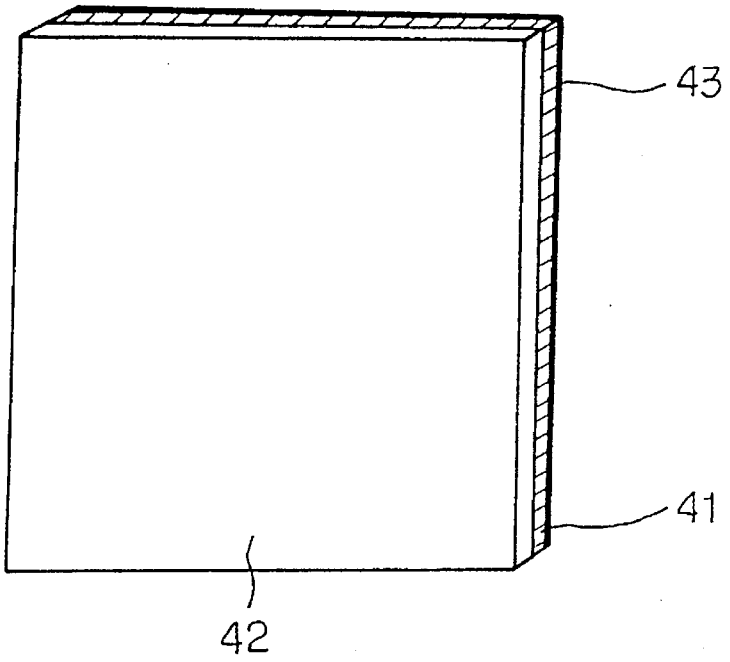
FIG. 11 is a perspective view showing a mirror having a reflection layer of silver-magnesium alloy according to the present invention.

Turning to FIG. 11 of the drawings, a reflection layer 41 of silver-magnesium alloy is deposited on a glass plate 42 to 1000 angstroms to 1 micron, and a protective layer 43 of synthetic resin covers the reflection layer 41. The silver-magnesium alloy contains magnesium ranging between 1 atom % and 5 atom %, because a high reflectance larger than that of aluminum is expected. The silver-magnesium alloy is similar in reflectance to chromium, and the corrosion resistance is superior to that of the chromium.

Figure 12:
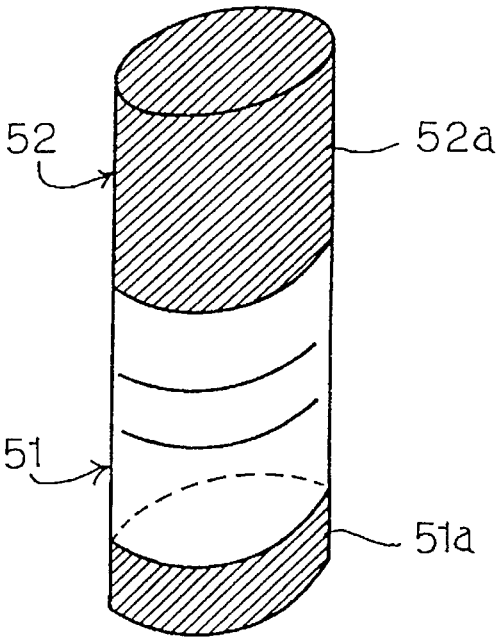
FIG. 12 is a perspective view showing a case for cosmetics partially covered with reflection films of silver-magnesium alloy according to the present invention.
Figure 13:
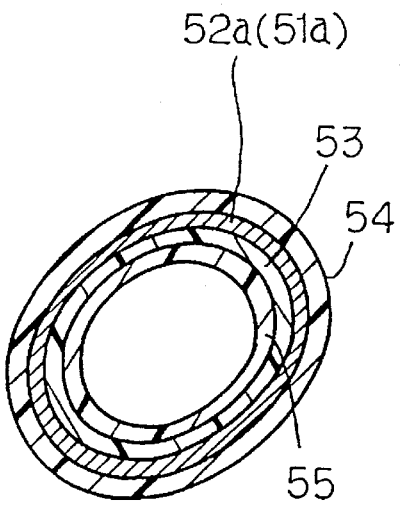
FIG. 13 is a cross sectional view showing the case.

Turning to FIGS. 12 and 13 of the drawings, a case for cosmetics comprises a body 51 and a cap 52. The body 51 is partially covered with a reflection film 51*a*, and the cap 52 is completely covered with a reflection film 52*a*. The reflection films 51*a* and 52*a* are sandwiched between an inner tubular resin layer 53 and an outer tubular resin layer 54, and the laminated structure 51*a*/52*a*, 53 and 54 covers a tubular resin member 55.

The silver-magnesium alloy contains magnesium ranging between 1 atom % and 5 atom %, and is 1000 angstroms to 1 micron thick. A high reflectance not less than 90% is expected for the reflection films 51*a* and 52*a*, and the reason for the high reflectance is identical with that of the reflection layers 34 and 41.

The silver-magnesium alloy according to the present invention is deposited through a sputtering technique, a vacuum evaporating technique and an ion-plating technique. A magnetron-sputtering is desirable for the deposition, because the composition is precisely controllable, the silver-magnesium alloy film hardly peels and a large-sized substrate is available. Therefore, the silver-magnesium alloy may be deposited by using a magnetron-sputtering system for the magneto-optical recording medium and the optical record medium. On the other hand, the vacuum evaporation and the ion-plating may be used for plastic products for home use and mirrors.

Figure 14:
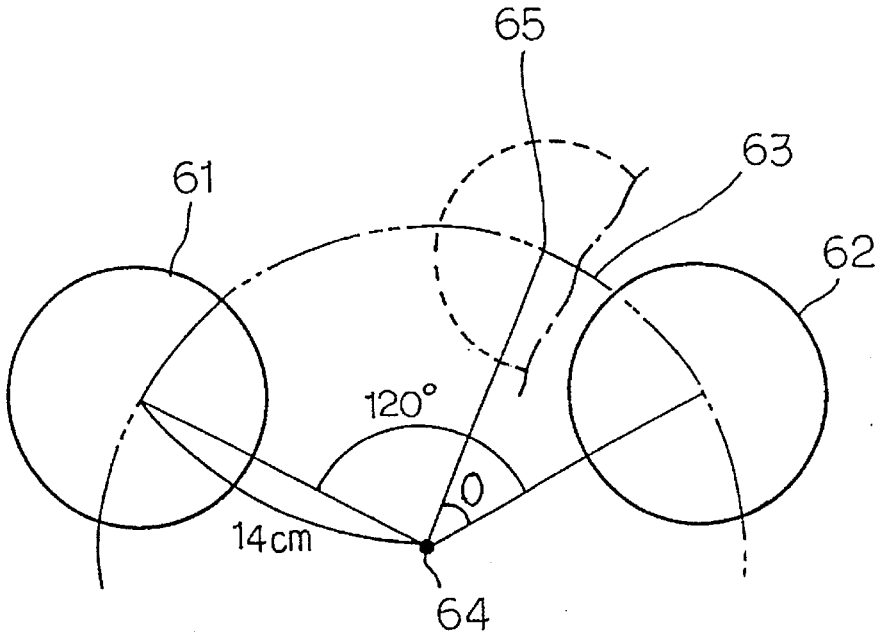
FIG. 14 is a plan view showing a sputtering chamber of a co-sputtering system used for a deposition of silver-magnesium alloy according to the present invention.
Figure 15:
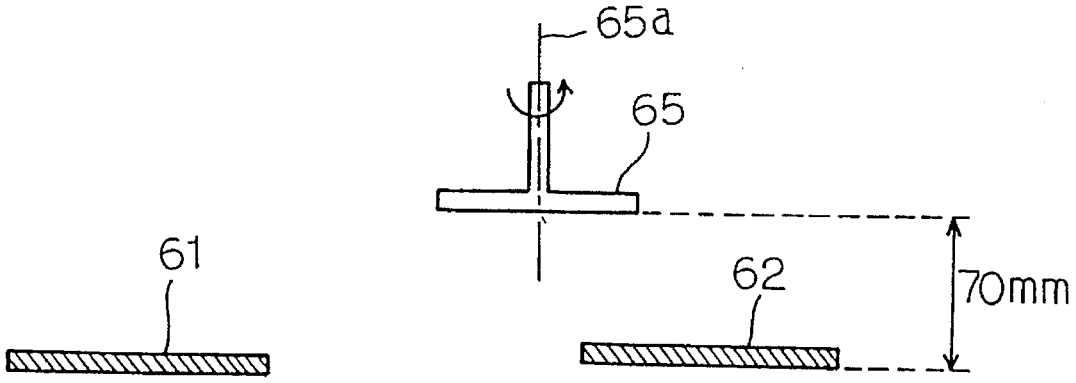
FIG. 15 is a side view showing the sputtering chamber.

FIGS. 14 and 15 show a chamber of a co-sputtering system, and a 5-inch magnesium target 61 is angularly spaced from a 5-inch silver target 62 by 120 degrees. Both targets 61 and 62 are placed on a virtual circle 63 14 centimeter spaced from a center 64 of the chamber. A holder 65 is 70 millimeter spaced over the targets 61 and 62, and holds a substrate structure (not shown). The holder 65 has a center axis 65*a*, and is rotatable around the center axis. The holder 65 is angularly movable along the circle 63, and, accordingly, angle (theta) is variable. The composition of silver-magnesium alloy is depending upon the angle (theta). For example, if angle (theta) is zero, the magnesium content of silver-magnesium alloy is 1.28 atom %. If the angle (theta) is changed to 20 degrees, the magnesium content is increased to 6.18 atom %.

While sputtering the targets 61 and 62, argon gas is introduced in the chamber at $1\times10^{-3}$ torr, and the vacuum reaches $5\times10^{-7}$ torr. High frequency electric power at 100 watts is applied to the silver target 62, and the magnesium target 61 is powered with high frequency electric power at 150 watts. The high frequency electric powers are variable for getting a desirable composition of the silver-magnesium alloy. In this instance, the high-frequency electric powers are fixed, and the lateral distance is changed. However, if the high-frequency electric powers are changed, the composition of silver-magnesium alloy is delicately changed.

Figure 16C:
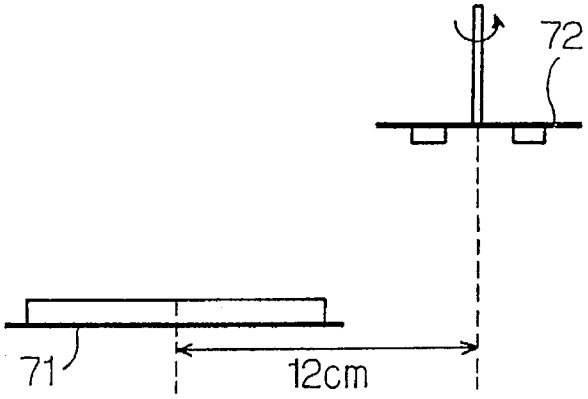
FIGS. 16A to 16C are side views showing a sputtering using a silver-magnesium target.
Figure 16B:
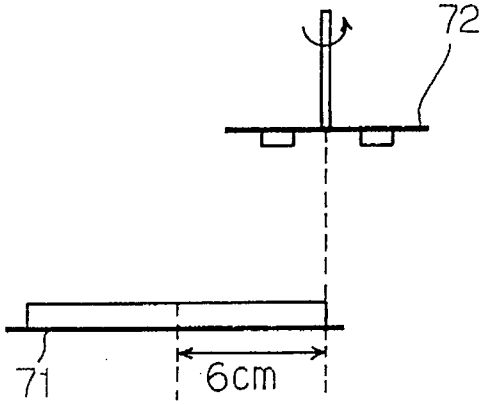
Figure 16A:
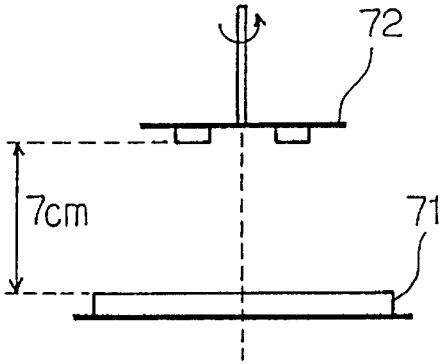

Turning to FIGS. 16A to 16C of the drawings, an alloy target 71 is placed in another sputtering chamber, and the alloy target 71 is of silver-magnesium alloy containing magnesium at 3.5 atom %. Although the vertical distance between the alloy target 71 and a holder 72 is fixed to 7 centimeter, the lateral distance therebetween is variable with as shown in FIGS. 16A to 16C.

A sputtering was carried out in the chamber under the conditions where high-frequency electric power was regulated to 200 watts, argon gas was introduced at $1\times10^{-3}$ torr and the vacuum in the chamber was $5\times10^{-7}$ torr, and silver-magnesium alloy films were deposited to 1000 angstroms. The silver-magnesium alloy obtained in the relative position shown in FIG. 16A contained silver at 98.533 atom % and magnesium at 1.467 atom %, and the reflectance immediately after the sputtering was 96.15%. The silver-magnesium alloy obtained in the relative position shown in FIG. 16B contained silver at 98.764 atom % and magnesium at 1.236 atom %, and the reflectance immediately after the sputtering was 96.68%. The silver-magnesium alloy obtained in the relative position shown in FIG. 16C contained silver at 98.962 atom % and magnesium at 1.038 atom %, and the reflectance immediately after the sputtering was 96.94%. The reflectance was measured by using an ellipsometer.

Thus, the composition of the silver-magnesium alloy is variable with the lateral distance.

As will be appreciated from the foregoing description, the silver-magnesium alloy according to the present invention is hardly corroded by virtue of the magnesium oxide, and keeps the silver luster for a prolonged time period.

Although particular embodiments of the present invention have been shown and described, it will be obvious to those skilled in the art that various changes and modifications may be made without departing from the spirit and scope of the present invention. The silver-magnesium alloy according to the present invention is available for any product serving in a corrosive atmosphere containing sulfur and ozone.

What is claimed is:

1. A magneto-optical recording medium comprising a) a substrate transparent to an incident light, b) a recording layer formed over a major surface of said substrate, and having a plurality of magnetic domains for storing data bits, c) a reflection layer formed over said recording layer wherein said reflection layer has a thickness ranging from 500 angstroms to 1,000 angstroms, and wherein said reflection layer comprises a silver-magnesium alloy containing magnesium in an amount ranging from 1 atom % to 5 atom %, wherein the surface of said silver-magnesium alloy is coated with magnesium oxide.

2. The magneto-optical recording medium according to claim 1, wherein the reflection layer has a reflectance of 90% or more.

3. An optical recording medium comprising a) a base film having an array of pits formed in a surface portion thereof for storing information, and transparent to an incident light, b) a reflection layer formed on said surface portion of said base film, wherein said reflection layer has a thickness ranging from 500 angstroms to 1,000 angstroms, and wherein said reflection layer comprises a silver-magnesium alloy containing magnesium in an amount ranging from 1 atom % to 5 atom %, wherein the surface of said silver-magnesium alloy is coated with magnesium oxide, and c) a protective film formed on said reflection layer.

4. The optical recording medium according to claim 3, wherein the reflection layer has a reflectance of 90% or more.

* * * * *

UNITED STATES PATENT AND TRADEMARK OFFICE

CERTIFICATE OF CORRECTION

PATENT NO. : 5,612,133

DATED : March 18, 1997

INVENTOR(S) : Mori, et. al.

It is certified that error appears in the above-identified patent and that said Letters Patent is hereby corrected as shown below:

Title page, item [54] and col. 1, in the title should read -- "MAGNETO-OPTICAL RECORDING MEDIUM HAVING A REFLECTING LAYER OF A SILVER-MAGNESIUM ALLOY HAVING A MAGNESIUM OXIDE COATING".

Title page, item [57],

In the Abstract, please delete "without an intermetallic compound" from line 5.

In Figure 14:

Please delete: " 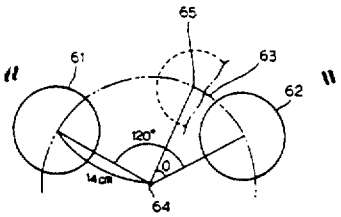

Fig. 14", insert therefor: -- 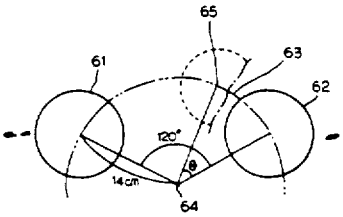

Fig. 14--.

In column 1, line 22, please delete "in water";

line 23, please delete "a";

line 46, please delete "radiates" and insert therefor --conducts--;

line 47, please delete "hardly" and insert therefor --easily--.

In column 3, lines 13-15, please delete ", and the intermetallic compound is hardly oxidized at room temperature".

UNITED STATES PATENT AND TRADEMARK OFFICE

CERTIFICATE OF CORRECTION

PATENT NO. : 5,612,133
DATED : March 18, 1997
INVENTOR(S) : Mori, et. al.

It is certified that error appears in the above-identified patent and that said Letters Patent is hereby corrected as shown below:

In column 4, lines 1-2, please delete ", and the oxidation increases the silver content in the surface";

line 19, please delete "purity" and insert therefor --reflectance--.

In column 5, line 64, please delete "similar" and insert therefor --superior--;

line 65, please delete "superior" and insert therefor --similar--.

Signed and Sealed this

Seventh Day of April, 1998

Bruce Lehman

*Attest:*

BRUCE LEHMAN

*Attesting Officer*

*Commissioner of Patents and Trademarks*